United States Patent [19]

Kaup

[11] Patent Number: 4,962,653

[45] Date of Patent: Oct. 16, 1990

[54] DRIVE ROD LOCK

[75] Inventor: Ludger Kaup, Everswinkel, Fed. Rep. of Germany

[73] Assignee: Aug. Winkhaus GmbH & Co. KG, Telgte, Fed. Rep. of Germany

[21] Appl. No.: 380,995

[22] Filed: Jul. 17, 1989

[30] Foreign Application Priority Data

Jan. 17, 1989 [DE] Fed. Rep. of Germany ..... 3901223

[51] Int. Cl.[5] ..... E05B 59/00

[52] U.S. Cl. ..... 70/107; 70/108; 292/39; 292/51

[58] Field of Search ..... 70/108, 107, 110, 111; 292/346, 39, 51

[56] References Cited

U.S. PATENT DOCUMENTS

| | | | |
|---|---|---|---|
| 959,494 | 5/1910 | Fisher | 292/51 |
| 1,471,061 | 10/1923 | Reineman | 292/346 |
| 1,800,662 | 4/1931 | Rush | 292/346 |
| 2,492,322 | 12/1949 | Russell | 292/346 |
| 4,154,070 | 5/1979 | Bahry | 70/108 |
| 4,362,034 | 12/1982 | Amgar | 70/108 |
| 4,606,203 | 8/1986 | Esser | 70/107 |

FOREIGN PATENT DOCUMENTS

| | | |
|---|---|---|
| 363002 | 7/1981 | Austria . |
| 0168001 | 1/1986 | European Pat. Off. . |
| 2840285 | 3/1979 | Fed. Rep. of Germany . |
| 2919201 | 11/1980 | Fed. Rep. of Germany . |
| 8030977 | 3/1981 | Fed. Rep. of Germany . |
| 3015104 | 10/1981 | Fed. Rep. of Germany . |
| 3144663 | 6/1982 | Fed. Rep. of Germany . |
| 3148030 | 6/1983 | Fed. Rep. of Germany . |
| 3148031 | 6/1983 | Fed. Rep. of Germany . |
| 3520862 | 12/1986 | Fed. Rep. of Germany . |
| 3537786 | 4/1987 | Fed. Rep. of Germany . |
| 2403440 | 4/1979 | France . |

*Primary Examiner*—Robert L. Wolfe

*Attorney, Agent, or Firm*—Toren, McGeady & Associates

[57] ABSTRACT

In a drive rod lock the drive rod is moved from a lock cylinder through a step-down gearing between an open position and a closed position and vice versa. A coupling of the step-down gearing to the drive rod is proposed which permits, in the case of rotation of the lock cylinder through 2°×360°, of shifting the drive rod from the open position into the closed position against displacement, without a torque being introduced due to the blocking forces into the step-down gearing and thus the lock cylinder.

26 Claims, 14 Drawing Sheets

DRIVE ROD LOCK

BACKGROUND OF THE INVENTION

The invention relates to a drive rod lock comprising a drive rod displaceable between an open position and a closure position in combination with at least one lock element, a lock cylinder, a step-down gear between the lock cylinder and the drive rod for displacing the drive rod between the open position and the closure position and a block device for the drive rod which blocks the drive rod in the closure position against displacement in the direction of the open position without torque introduction into the step-down gear, where a control dog assembly for drive engagement in a dog engagement profiling of the drive rod is fitted on a drive rod drive pinion on the gear output side, and where furthermore a stop dog for action upon an abutment face of the drive rod is fitted on the drive rod drive pinion on the gear output side.

Such a drive rod lock is known from European Offenlegungsschrift No. 0,168,001. There reference is made especially to the illustration in FIG. 8 and to the parts of the description pertaining to FIG. 8.

In the known form of embodiment a single control dog is fitted on the drive rod drive pinion and is in drive engagement for the drive rod with one single recess of the drive rod. Furthermore in the known form of embodiment on the drive rod drive pinion a stop dog is fitted which comes into engagement in a further recess of the drive rod when the drive rod is situated in its open position, so that the drive rod, which is in the open position and is loaded in the direction of its closure position, is supported exclusively through the stop dog in the recess of the drive rod pertaining to the latter, without the introduction of substantial support forces into the step-down gear.

In the known form of embodiment for the transference of the drive rod out of the open position into the closure position a rotation of the lock cylinder through $2\times360°$ is carried out starting from a zero or key-withdrawal position of the lock cylinder. In order then further to block the drive rod in its closure position reached after this rotation through $2\times360°$, the lock cylinder is rotated through a further 360°; during this further rotation through a further 360° then the stop dog arrives, with the drive rod stationary, in the drive rod recess provided for it.

It is felt to be inconvenient that for the blocking of the drive rod, after its locking position has already been reached by rotation of the lock cylinder twice through 360°, a further rotation of the lock cylinder must be carried out through a further 360°.

SUMMARY OF THE INVENTION

The invention is based upon the problem, in a drive rod lock of the kind as initially designated, of indicating a construction which is simpler in assembly or at least constantly simple and which permits of carrying out the transition from the open position of the drive rod to the blocking of the drive rod situated in the closure position, with a smaller number of rotations of the lock cylinder.

To solve this problem it is proposed in accordance with the invention that (a) the dog engagement profiling is made with two recesses;

(b) the drive dog construction group comprises two control dogs fitted on the drive rod drive pinion, which dogs engage in successive recesses arranged by pairs in them;

(c) The stop dog in the middle region of the circumferential spacing between the two control dogs is arranged on the drive rod drive pinion;

(d) the recess subject to the action of a control dog when the drive rod is in the closure position is formed with a limiting finger;

(e) the stop dog, when the drive rod is in the closed position, rests on the limiting finger on its flank remote from the recess loaded by the control dog, hereinafter called blocking flank;

(f) the drive rod reaches its closed position before the closing rotating movement of the lock cylinder and of the drive rod drive pinion is terminated, and the stop dog, after entry of the drive rod into the closure position, reaches its blocking position on the blocking flank of the limiting finger during the then still available remaining closure rotating movement of the lock cylinder and of the drive rod drive pinion.

With the configuration of the drive rod lock in accordance with the invention it is especially possible that the drive rod, starting from the open position and accordingly from a zero position (key withdrawal position) of the lock cylinder, reaches its closure position after less than $2\times360°$ lock cylinder rotation, and that the remaining lock cylinder rotation corresponding to the rest up to $2\times360°$ serves for driving the stop dog into the blocking position in relation to the blocking flank of the limiting finger.

Although in the solution according to the invention a transition from the open position of the drive rod into the blocked condition of the drive rod situated in the closed position is achievable with only two lock cylinder rotations, the forces occurring within the lock can be kept small and the torque to be expanded on the lock cylinder likewise remains slight.

In order to indicate a measure for a preferred dimensioning of the step-down ratio within the driving rod lock, let it be said that the drive rod drive pinion in a closing rotating movement of the lock cylinder of $2\times360°$ carries out a closing rotating movement of about 200°. This closing rotating movement of the drive rod drive pinion is used firstly to shift the drive rod from the open position into the closed position and in order further to block the drive rod in the closed position due to the fact that the stop dog runs up on to the blocking flank of the limiting finger. In this case the remaining closure rotating movement of the drive rod drive piston after entry of the drive rod into the closure position can be small, for example about 20°. This shows that for the movement of the drive rod out of the open position into the closed position by far the predominant proportion of the lock cylinder rotation distance of $2\times360°$ is available; this fact is responsible for a favorable transmission ratio between the movement of the lock cylinder for the one part and of the drive rod for the other part and thus for low gear forces during the opening and closing movements of the drive rod and for low torque expenditure on the lock cylinder.

The control dogs and the stop dog can protrude axially from one end of the drive rod drive pinion, with a view to a simple design assembly, in which case then a part of the drive rod carrying the recesses can rest on this end of the drive rod drive pinion.

Especially favorable forces and movement ratios result in the lock when the control dogs have a circumferential spacing of about 90° and when the circumferential distance of the stop dog from each of the two control dogs amounts to about 135°. It is to be noted here that these angular intervals are each calculated from dog center to dog center.

For reasons of stability it is advantageous if the control dogs are connected with one another by a flange, an aperture lying between them being preserved for the engagement of a projection lying between the two recesses.

The drive rod lock in accordance with the invention can be produced especially in the form where a bolt or main bolt movable transversely of the direction of movement of the drive rod is provided and is displaceable by the drive rod between a retracted position and an extended position. In the case of such a form of embodiment with bolt the drive of the bolt from the drive rod can take place somewhat in a manner in which a stationarily mounted bell-crank lever is connected by a first arm by a pin-slot connection with a bolt tail of the bolt and that a second arm of the bell-crank lever, namely a control arm, is in engagement with a control profiling of the drive rod. In that case the control profiling can comprise control faces arranged at right angles with spacing to the direction of movement of the bolt, for the extension and retraction of the bolt, and an end face substantially parallel to the direction of movement of the drive rod for the blocking of the extended bolt.

An additional blocking of the extended bolt can be effected in that a shoulder is fitted on the bolt and a shoulder engagement pin on the drive rod, the should engagement pin coming into engagement blocking the bolt, behind the shoulder, after the bolt has reached its fully extended position. Due to the simultaneous engagement of the control arm with the end face of the control profile for the one part and of the shoulder with the shoulder engagement pin for the other part an extremely stable blocking against violent inward pushing of the bolt is achieved, the support forces being so distributed within the lock that there is no fear of damage toward parts.

The drive rod lock can also be equipped with at least one pivot bolt which is pivotable by the drive rod between a pivoted-in position and a pivoted-out position. In further development of the invention here a rack can be provided on the drive rod for the pivoting of the pivot bolt and correspondingly a toothed segment on the pivot bolt.

This toothed segment can be fitted on a hub part of the pivot bolt of hook-shaped formation.

The pivot bolt itself can here be part of an additional lock secured on a flange piece of the lock.

The lock formed in accordance with the invention can further be equipped with a catch which in known manner snaps into engagement automatically into a keep on slamming of the door equipped with the lock. This catch is initially stressed in the ordinary way under spring pressure into a closure position and can be retracted into an open position according to choice by rotation of a handle nut or from the lock cylinder. In further development of the invention it is here possible for an engagement member to be provided on the drive rod drive pinion, which member, on rotation of the lock cylinder beyond its zero position corresponding to the open position of the drive rod, strikes against a nose of a catch lever acting upon the catch.

The catch can fundamentally be of the ordinary prismatic form of construction, that is the catch, considered in a sectional plane perpendicular to the plane of the door lock and parallel to the direction of movement of the catch, has a triangular cross-section with a catch abutment slope and a catch engagement blank, and further that is that the catch comprises end faces substantially parallel to this sectional plane. In the case of such a formation of the catch it has appeared that unauthorized attempts at opening are possible in a manner in which a flat bar or a flat metal piece is introduced into the interspace between keep and flange piece and moved obliquely in such a way that it acts with one edge on an edge of the catch which is formed by the catch abutment slope for the one part and one of the end faces for the other part. In this way then the catch can be pressed back. In order to prevent such pressing back of the catch it is further proposed that in the edge regions formed by the end faces and by the catch abutment slope, which lie close before the outer surface of the flange piece when the catch is extended, recesses are provided. If then a flat bar or flat metal piece is used in the above-described manner for an unauthorized opening attempt, then the edge of the flat bar or metal piece running up onto the catch hooks itself on the recess of the edge of the catch, so that after a short distance the forcing back of the catch comes to a halt and remains blocked.

The above-mentioned formation of the catch in accordance with the invention is to enjoy protection independently of the previously discussed features of the drive rod lock.

The recesses on the catch can be formed especially as grooves which extend parallel to the outer surface of the flange piece and, in the case of the presence of catch guide ribs extending along the catch detent flank and along the end faces of the catch, terminate before or at these catch guide ribs. Thus the catch guide ribs remain unworn and there is no danger that they hook in the guides of the flange piece in the retraction of the catch.

According to another aspect of the invention commencement is made from a drive rod lock comprising a drive rod displaceable between an open position and a closure position, in combination with at least one lock element, a lock cylinder, a step-down gearing between the lock cylinder and the drive rod for the displacement of the drive rod between the open position and the closure position, where the step-down gearing possesses on the lock cylinder side a toothed rim which meshes with two drive wheels arranged after it and comprises a slot open to the edge and formed for the insertion of the locking bit of the lock cylinder, and where a drive rod drive member of the step-down gearing, rotatable about a non-displaceable axis, acts through an engagement device upon the drive rod, further comprising, a bolt which is displaceable transversely of the longitudinal axis of the drive rod between a retracted position and an extended position and is driveable through movement-converting means from the drive rod, further comprising a catch initially stressed by spring force into a closure position, which can be drawn back for the one part by a handle nut and for the other from the lock cylinder against the spring force, the slot of the toothed rim being displaceable out of its zero degree position in at least one direction of rotation over a range of angle of variation of the lock bit, without the occurrence of displacement of the bolt.

Such a drive rod lock is known from DE-PS No. 2,919,201. In the known drive rod lock the displacement of the thrust bolt on a pivoting of the slot of the toothed rim out of its zero degree position through the range of angle of variation of the lock bit is rendered possible by the fact that the movement conversion means between the bolt and the drive rod are formed an oblique slot of the drive rod and a slot-follower bolt of the thrust bolt and that the oblique slot of the drive rod is supplemented by a niche extending in the direction of movement of the drive rod, which niche the pin of the thrust bolt has entered in the reclosed end position of the thrust bolt, and possesses axial movement play.

In this known solution the catch is driven by the drive rod. For the return of the catch the drive rod is moved from the lock cylinder and takes the catch back with it, the thrust bolt being stationary thanks to the movement play of its pin in the niche. This form of embodiment is afflicted by considerable disadvantages: for the retraction of the catch the drive rod must always be moved with it. This signifies additional expenditure of force and additional wear phenomena in the drive rod lock and requires additional adaptation of the locking plates on the frame in order to guarantee an appropriate movement play for the locking elements on the drive rod side in the drive rod movement necessary for the catch retraction. Furthermore, it is disadvantageous that when the lock is in the open position, on setting of the lock cylinder into the key withdrawal position and with the key withdrawn, an action upon the drive rod, as within a break-in attempt, can lead to a reaction through the gearing to the lock cylinder with the consequence that the tumblers of the lock cylinder are loaded.

The invention is based upon the problem, while retaining the range of angle of variation for the lock cylinder bit and while retaining the immobility of the thrust bolt in displacements of the lock cylinder bit within this range of variation angle, of finding a solution in which actions upon the drive rod situated in the open position do not lead to lock cylinder loading, and the drive rod is stationary in the retraction of the catch from the lock cylinder.

For the solution of this problem it is proposed that a dog construction group, fitted on the drive rod drive member, with two control dogs and a stop dog and a dog engagement profiling fitted on the drive rod, with two recesses pertaining by pairs to the control dogs and two limiting fingers on both sides of the recesses, are formed in such a way that on a rotation of the toothed rim within the range of angle of variation of the lock bit, the engagement connection of the control dog, which is responsible for the beginning of the drive rod displacement out of the open position into the closure position, with the pertinent recess is released and the limiting finger, pertaining to this recess, engages between the stop dog and the spindle of the drive rod drive member, substantially blocking the displacement of the driver rod, and that the catch can be retracted by an engaging member of the drive rod member.

Here the movement conversion means between the bolt and the driver rod can comprise a conversion lever mounted pivotably on the lock housing, which lever for the one part is in tooth-type engagement with the drive rod and for the other part is in connection with the bolt through a pin/slot connection.

In order with minimum space requirement, especially with regard to the distance of the flange rail from the lock cylinder and the handle nut, to achieve the transmission ratio between the drive rod and the bolt which corresponds to a two-revolution rotation of the lock cylinder core, between the drive rod and the bolt, it can be provided that the tooth-type engagement between the drive rod and the conversion layer is affected by idle motion.

According to a first form of embodiment of the conversion lever solution it is provided that the conversion lever is a double lever which is in engagement with counter dog with a toothing of the drive rod and comprises in one arm a slot which forks a pin of the bolt. Here the toothing can comprise two drive dogs spaced by a recess guaranteeing an idle motion, namely a bolt-expelling drive dog and a bolt-retracting drive dog.

According to another form of embodiment of the conversion lever solution it is provided that the toothing-type engagement between the drive rod and the conversion lever is formed by a nose of the drive rod for the one part and two teeth of the conversion lever, separated by a tooth notch, for the other part, and that the conversion lever comprises a bolt engagement arm which engages with a pin in a slot of the bolt. The tooth notch can here be formed as a tooth notch permitting an idle motion.

BRIEF DESCRIPTION OF THE DRAWINGS

The accompanying Figures explain the invention by references to examples of embodiment.

DETAILED DESCRIPTION OF THE PREFERRED EMBODIMENTS

Figure 1:
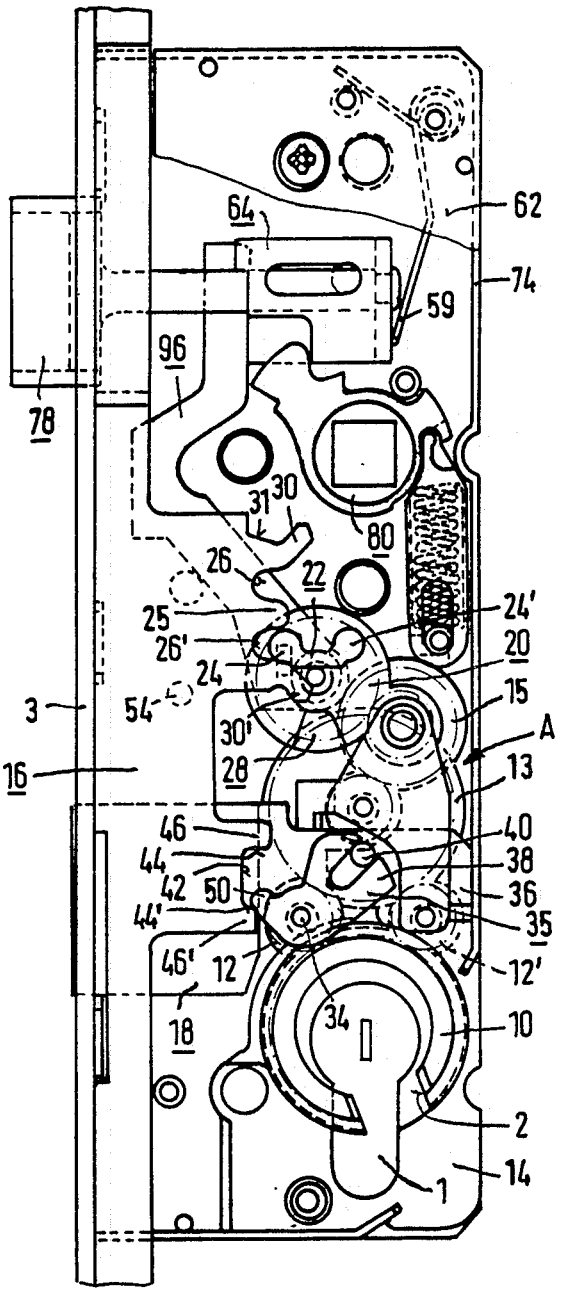
FIG. 1 represents an elevation, partially broken away, of a drive rod lock according to the invention in the open position.
Figure 1A:
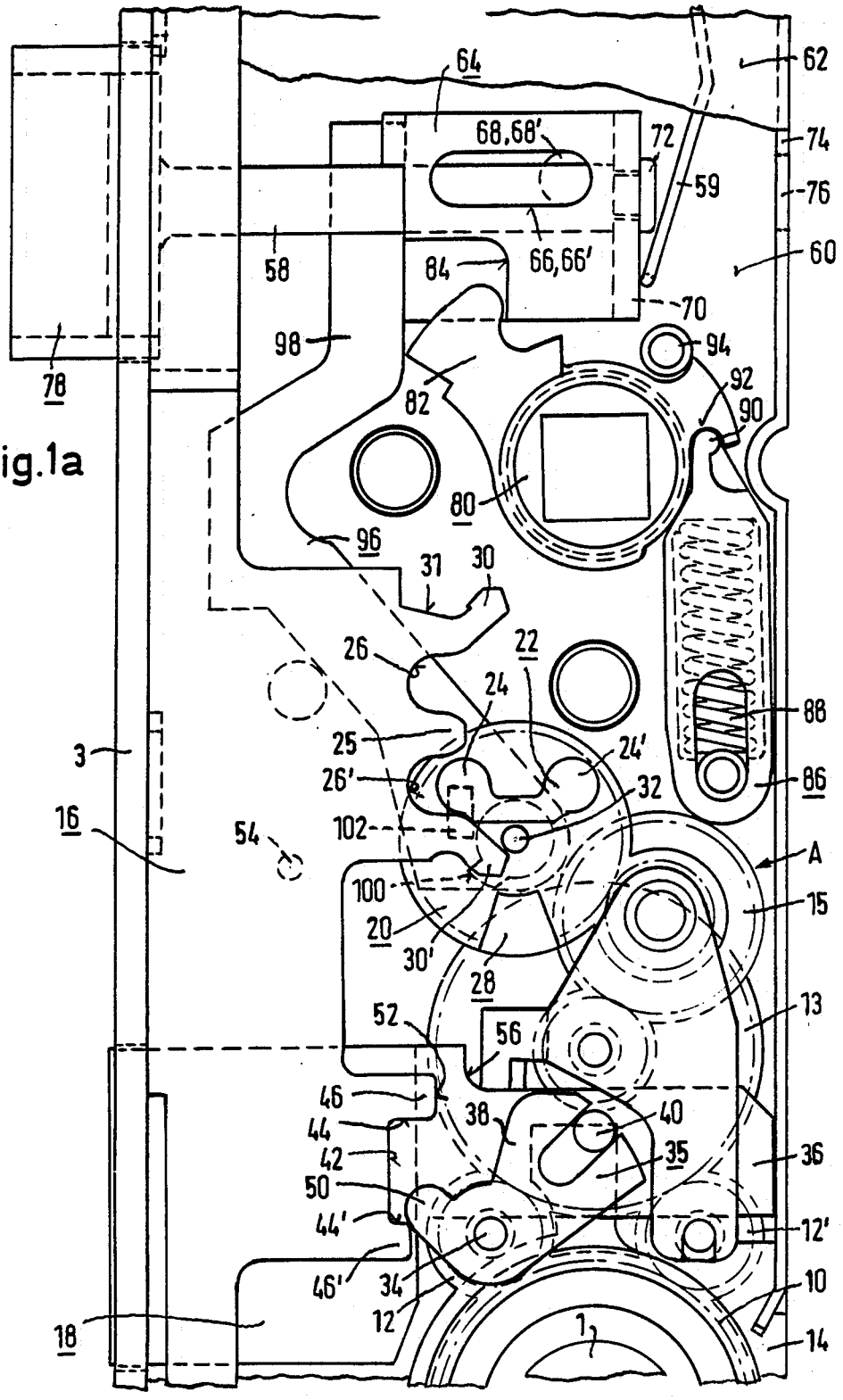
FIG. 1*a* represents an enlargement of FIG. 1.

As represented in FIGS. 1 and 1*a*, the lock bit hub (not shown) of the profiled cylinder 1 is surrounded by a toothed rim 10 which comprises a slot 2 for coupling with the lock bit, the diameter of the circle of rotation of the lock bit in the region of the two driven gear wheels 12, 12′ being smaller than the root circle diameter of the toothed rim 10. The toothed rim 10 is guided with a flange on the external circumference in a bearing 14 fast with the housing and meshes with the two driven gear wheels 12, 12′.

The locking and unlocking actuation of the drive rod 16 and of the bolt 18 are effected each through two rotations of the lock cylinder 1. At the end of a step-down gearing A, which is formed by the toothed wheels 10, 12—12′, 13 and 15, there is mounted a drive rod drive pinion 20 with a control element 22 firmly arranged on the end on the lock cover side. The control element 22 is formed at both ends with approximately circularly formed control dogs 24, 24′ which on closing actuation by the lock cylinder engage successively in corresponding apertures 26, 26′ of the drive rod 16 and displace the latter.

At the lock cover end of the pinion 20 there is further formed a stop dog 28, diametrically of the control element 22. The apertures 26, 26′ of the drive rod 16 for the engagement of the control dogs 24, 24′ are limited on the outsides by curved limiting fingers 30, 30′ directed into the lock interior, which extend approximately as far as the rotation axis 3 of the drive rod drive pinion 20.

When the drive rod 16 is pushed into the closure position (FIG. 2) the upper limiting finger 30 is driven under the stop dog 28. In the case of return forces acting in this position upon the drive rod 16 the limiting finger 30 is supported on the stop dog 28, whereby these forces are introduced into the axis 3 of the drive rod drive pinion 20. The return forces accordingly are not transmitted as turning moment to the gearing A and to the lock cylinder 1.

On the axle 34 of the toothed wheel 12 arranged close to the drive rod 16 a bell-crank lever 35 is pivotably mounted coaxially therewith, which partly grasps over a bolt tail 36. It grasps with an arm 38 of fork-type formation round a pin 40. A second arm 50 of the bell-crank lever 35 engages in a drive rod aperture 42 of the drive rod 16 which is limited by dogs 46, 46′ provided with right-angled control faces 44, 44′.

Figure 2:
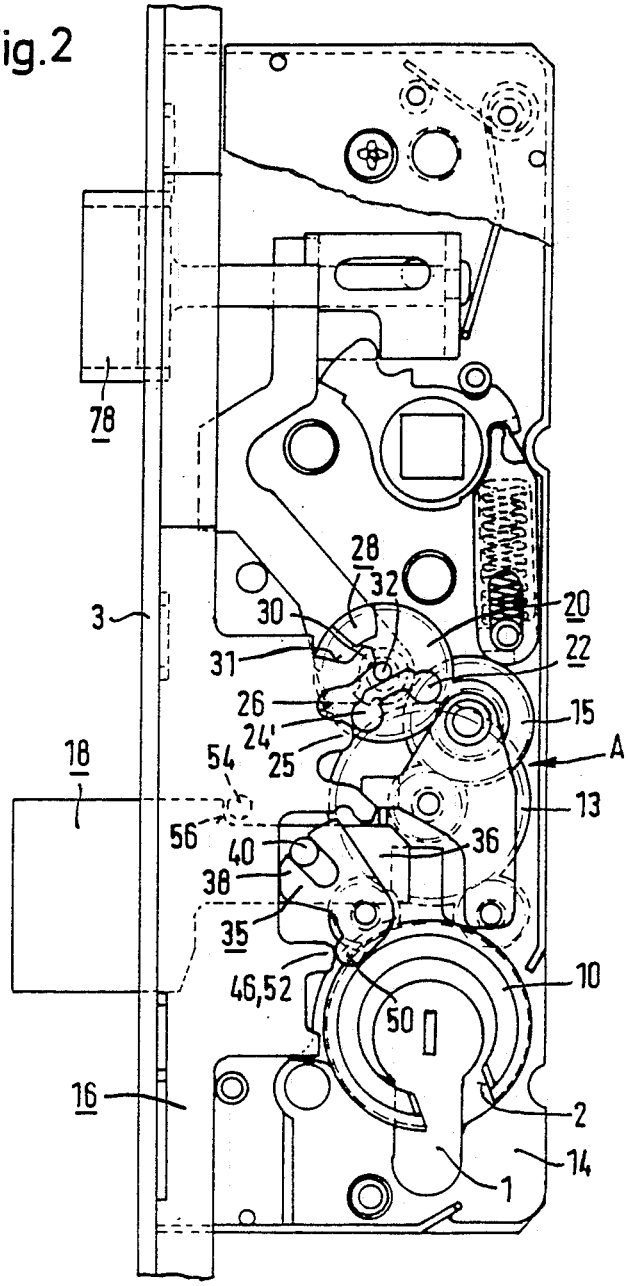
FIG. 2 represents a view corresponding to FIG. 1 with the drive rod in the closure position.

In the outward pushing of the drive rod 16 and the bolt 18 the lower control face 44 of the upper dog 46 comes to abut on the second arm 50 of the bell-crank lever 35 and pivots it in the counter-clockwise direction into the position according to FIG. 2. The bolt is excluded by the pin-slot connection 38, 40. After double locking rotation of the profiled cylinder 1 the bolt 18 is driven fully out and the arm 50 is then supported on the end face 52 of the upper dog 46 (FIG. 2). At the same time a pin 54 fast with the drive rod (FIG. 2) has been pushed behind a shoulder 56 of the bolt 18.

If now the attempt is undertaken to push the bolt back into the lock housing, then the occurring forces are introduced by way of the bolt pin 40 into the bell-crank lever 35 and seek to pivot the bell-crank lever in the clockwise direction. Since however the free end 50 of the bell-crank lever 35 is supported on the upper dog 46 the pivoting movement is blocked. As the pin 54 is pushed at the same time behind the shoulder 56, the forces acting upon the bolt 18 are also transmitted to the drive rod 16 (direction of action of the force to the right in the plane of the drawing), which in turn is supported in the opposite direction by the arm 50 of the bell-crank lever 35 (direction of action of the counter-force to the left). Thus gearing and lock cylinder remain relieved of the said forces.

The catch controlling of the catch 78 (FIG. 3) can be effected from the handle nut 80 of a door handle and/or from the lock cylinder 1. The catch tail 58 is secured in a housing 64 displaceable between lock bottom 60 and lock cover 62, the housing 64 having two mutually opposite longitudinal slots 66, 66′ on its wide sides for guidance, in each of which there engage short guide pins 68′, 68, arranged on the lock bottom 60 and on the lock cover 62. In FIG. 1 the lock cover 62 is shown broken away and only the guide pin 68′ secured on the lock bottom 60 is visible. The catch tail 58 is secured to the rear wall 70 of the housing 64 with a screw 72 which can be released for the purpose of catch conversion for right/left hanging. In the narrow housing rear wall 74 lying opposite to the lock flange piece 3 an opening 76 for the access of a tool is provided for access to the screw 72. The catch 78 is drawn, for conversion, so far out of the lock flange piece that turning through 180° is possible.

In the retraction of the catch 78 by the door handle the handle nut 80 is pivoted in the clockwise direction through about 45° and an engaging member 82 formed integrally on the handle nut 80 engages behind a shoulder 84 of the housing 64. The handle nut 80 is initially stressed in the direction of the extended catch 78 by a compression spring 88 inserted into a spring housing 86, the displaceable spring housing 86 engaging with a plunger 90 in a recess 92 of the handle nut 80. The handle nut 80 is supported in the normal position on a pin 94 which connects the lock bottom 60 and the lock cover 62.

For the catch actuation by means of the lock cylinder 1 a catch lever 96 is arranged on the lock bottom 60 pivotably coaxially with the drive rod drive pinion 20, which lever rests with its free end 98 on the housing 64. The gear connection with the catch lever 96 comprises an engaging member 100 arranged on the lock bottom end of the drive rod pinion 20, which engaging member, with the bolt 18 enclosed and on further clockwise rotation of the lock cylinder, comes to abut on a nose 102 of the catch lever 96 and pivots the latter in the clockwise direction.

Figure 4:
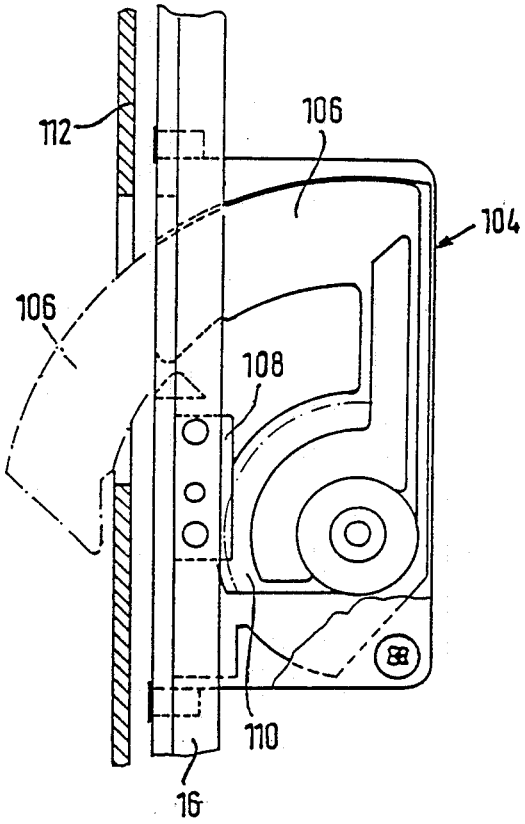
FIG. 4 represents an additional lock with a pivot bolt.
Figure 5:
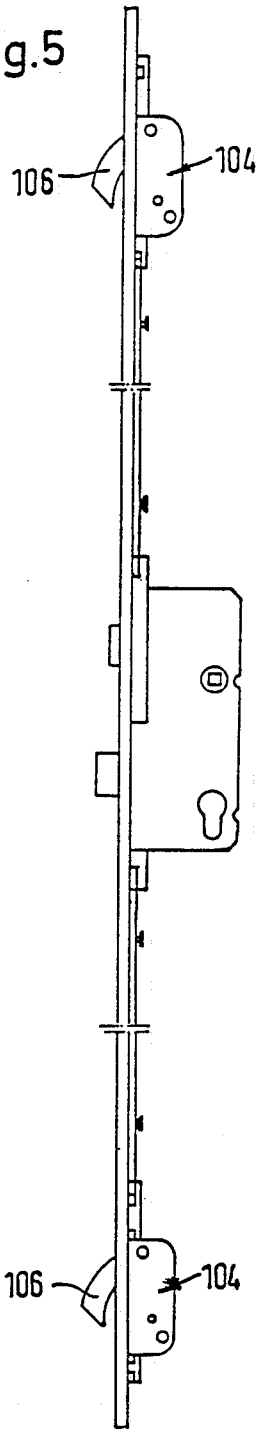
FIG. 5 represents a flange rail drive rod unit with a drive rod lock in accordance with the invention and two additional locks.
Figure 6:
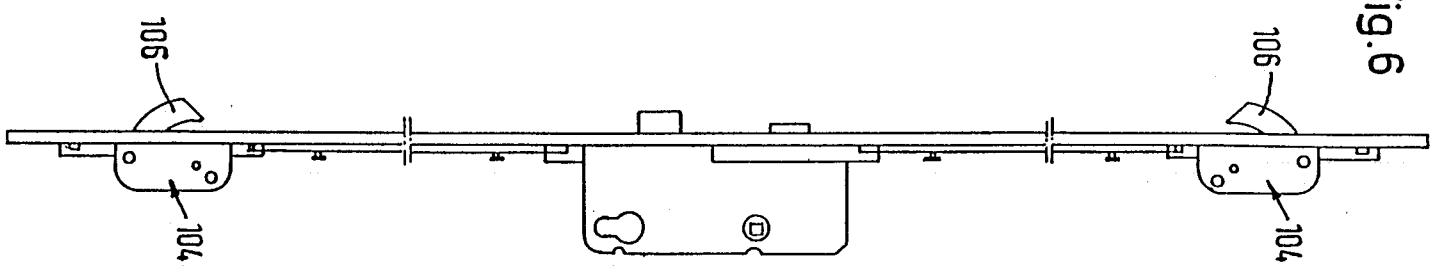
FIG. 6 represents an arrangement according to FIG. 5 with oppositely directed pivot bolts.

In FIGS. 4, 5 and 6 there is represented an additional lock 104 provided for a multiple locking system, which lock is equipped with a pivoting bolt 106 of hook form. The drive rod 16 is guided in the region of the additional lock 104 with its narrow side on the flange rail 3 and is cranked so that it rests displaceably directly on the lock cover. On the wide side of the drive rod 16 remote from the lock cover a rack 108 is secured (riveted) within the additional lock, and is in engagement with a toothed segment 110 formed on the pivoting bolt 106. The extended pivoting bolt 106 engages in known manner in a keep 112 on the door frame.

In FIG. 6 the hook-shaped pivoting bolts 106 are arranged oppositely, compared with the arrangement according to FIG. 5.

Figure 7:
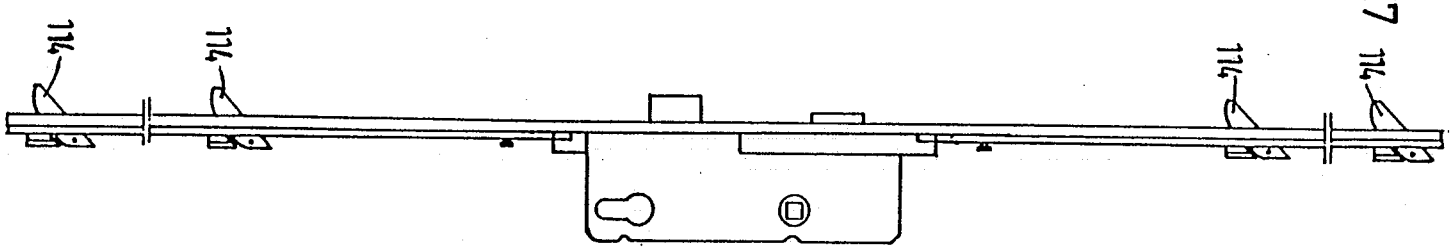
FIG. 7 represents an arrangement according to FIG. 5 with modified pivot bolts.
Figure 8:
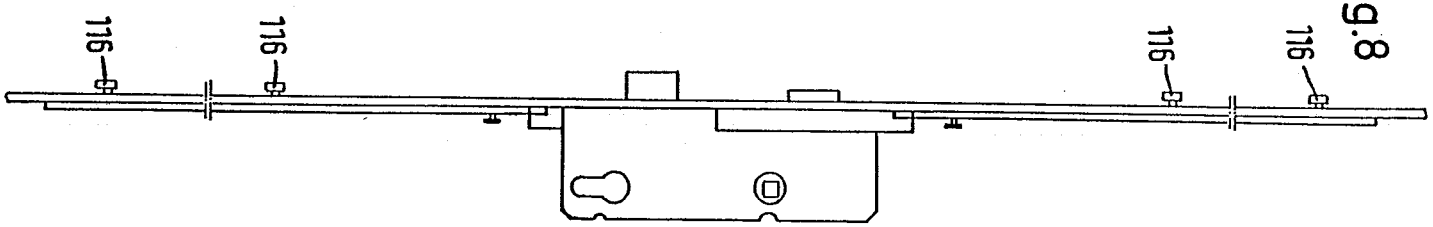
FIG. 8 represents an arrangement according to FIG. 5 with closer blocks rigidly secured to the drive rod.

In FIG. 7 the additional bolts are formed as known pivotable bolt tongues 114 and in FIG. 8 as lock blocks 116.

In FIGS. 1 and 1*a* the lock cylinder 1 is situated in the zero position in which the key can be inserted and withdrawn. The catch 78 is situated in the projecting position in which it can engage in a keep when the door equipped with the lock is pressed shut. This catch is initially stressed into the protruding position by a catch spring 59 (see FIG. 1*a*). The drive rod 16 is situated in the open position in FIGS. 1 and la, that is the highest possible position of all. The bolt 18 is situated in the retracted position.

For the transference of the drive rod 16 into the closure position the lock cylinder is turned in the counter-clockwise direction by means of the inserted key. Through the toothed rim 10 then the gearing A is driven, so that the drive rod drive pinion 20 likewise rotates in the counter-clockwise direction. In that action the control dog 24 engages in the recess 26, of the drive rod 16 and presses the drive rod downwards in the direction towards the closure position. In the course of further rotation of the lock cylinder in the counter-clockwise direction the control dog 24' comes into engagement with the recess 26 of the drive rod 16, while the control dog 24 emerges from the recess 26'.

After a lock cylinder rotation of $2\times360°$ the condition according to FIG. 2 is reached in which the drive rod 16 has reached its closure position, that is its lowest position. The stop dog 28 lies against the blocking flank 31 of the limiting finger 30, so that on an attempt to push the drive rod 16 upwards the limiting finger 30 pushes against the stop dog 28 and thus an upward displacement of the drive rod 16 is blocked. The blocking force is then introduced in a radial direction, in relation to the drive rod drive wheel 20, directly into the axis of rotation 32 of the drive rod drive pinion 20 and does not act as a torque which is introduced into the step-down gearing A.

The drive rod 16 has already reached its closure position as illustrated in FIG. 2 before the stop dog 28 has passed over the limiting finger 30. This appears from FIG. 2 and there especially from the position of the control dog 24' in relation to the projection 25 placed between the two recesses 26 and 26'. It is seen there that the drive rod 16 carries out no more downward movement even before the control dog 24' has reached the position according to FIG. 2. This means that the stop dog 28 runs over the limiting finger 30, with the drive rod stationary, and thus reaches the position as represented in FIG. 2.

During the downward movement of the drive rod 16 from the position according to FIG. 1 into the closure position according to FIG. 2 the control face 44 of the dog 46 strikes upon the second arm 50 of the bell-crank lever 35 and rotates the latter in the counter-clockwise direction, so that through the pin-slot connection 38, 40 the bolt tail 36 and thus the bolt 18 are shifted to the left into the closure position. The beginning of this displacement depends upon the position of the control face 44 in relation to the axis 34 of the bell-crank lever 35. As a result of the pivoting of the bell-crank lever then finally the second arm 50 of the bell-crank lever 35 arrives on the end face 52 of the dog 46. Then a further pivoting of the bell-crank lever 35 in the counter-clockwise direction no longer occurs, even if the drive rod 16 is displaced still further downwards. A pushing back of the bolt 18 is however no longer possible, because such pushing back of the bolt 18 would result in pivoting of the bell-crank lever 35 in the clockwise direction, which is prevented by the abutment of the second arm 50 on the end face 52. The drive rod 16, driven by the lock cylinder 1, moves still further downwards after the bolt 18 has already reached its fully extended end position. In that movement, as represented in FIG. 2, the pin 54 of the drive rod 16 arrives behind the shoulder 56 of the bolt 18. Then pushing back of the bolt 18 even by the pin 54 is prevented. The driver rod 16 is here stabilized in the region of the pin 54 by the fact that it rests with the end face 562 of the dog 46 on the second arm 50 of the bell-crank lever 35, which in turn is supported by the pin-slot connection 38, 40.

During the downward movement of the drive rod 16 out of the open position according to FIGS. 1 and 1*a* into the closed position according to FIG. 2 furthermore as represented in FIG. 4 the pivot bolt 106 is pivoted out in the counter-clockwise direction, due to the fact that the rack 108 rolls on the toothed segment 100 of the pivot bolt 106.

In the return of the drive rod 16 out of the closure position according to FIG. 2 into the open position according to FIGS. 1 and 1*a*, the upward movement of the drive rod 16, as may be seen from FIG. 2, begins only after the stop dog 28 has departed again from the blocking flank 31 of the limiting finger 30, because the control dog 24' comes into engagement again with the upper flank, formed by the limiting finger 30, of the recess 26 only after an initial rotation of the drive rod drive pinion 20. By further rotation of the lock cylinder in the clockwise direction then the condition according to FIGS. 1 and 1*a* is reached again.

Figure 3:
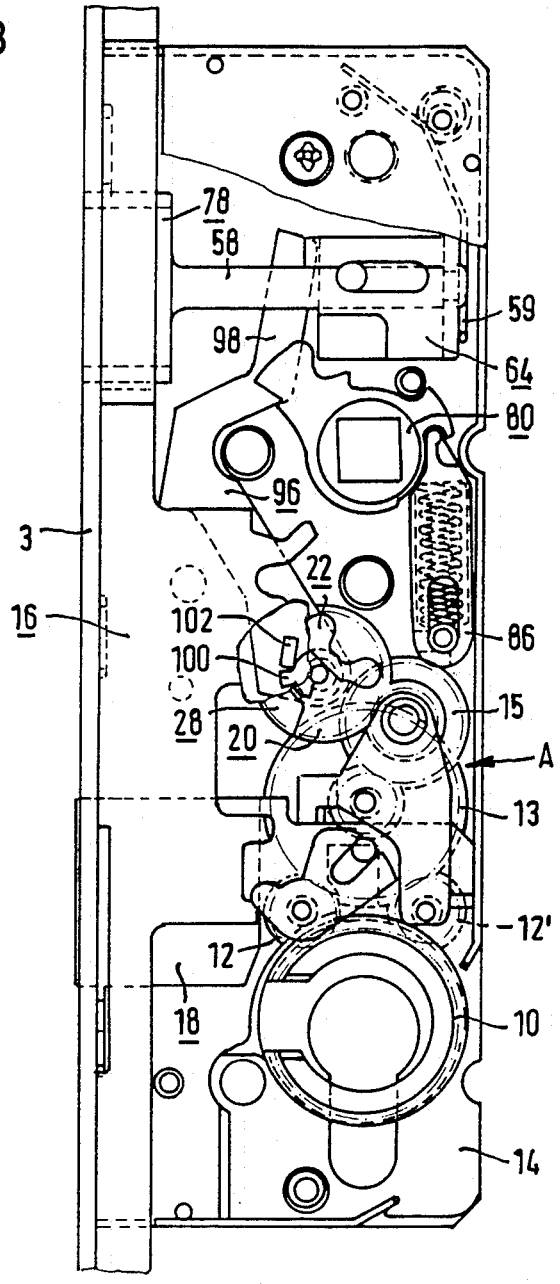
FIG. 3 represents a view corresponding to FIG. 1 on retraction of the catch by rotation of the lock cylinder.

If the catch 78 is to be retracted, starting from the condition according to FIGS. 1 and 1*a*, the lock cylinder 1 is rotated through about 45° in the clockwise direction. In that action the engaging member 100, as represented in FIG. 3, which is fitted on the side of the drive rod drive pinion 20 remote from the control dog 24, 24', comes into engagement with the nose 102 of the catch lever 96, with the consequence that the catch lever 96 is pivoted in the clockwise direction and through the housing 64 pushes the catch 78 back. It is here to be noted that in the transition from the position according to FIGS. 1 and 1*a* for the one part to the position according to FIG. for the other part the control dig 24 exerts no engaging movement upon the drive rod 16, since it does not come into engaging contact with the flank of the recess 26' formed by the projection 25. Thus, no movement of the drive rod 16 occurs in the retraction of the catch 78 from the lock cylinder.

Figure 9:
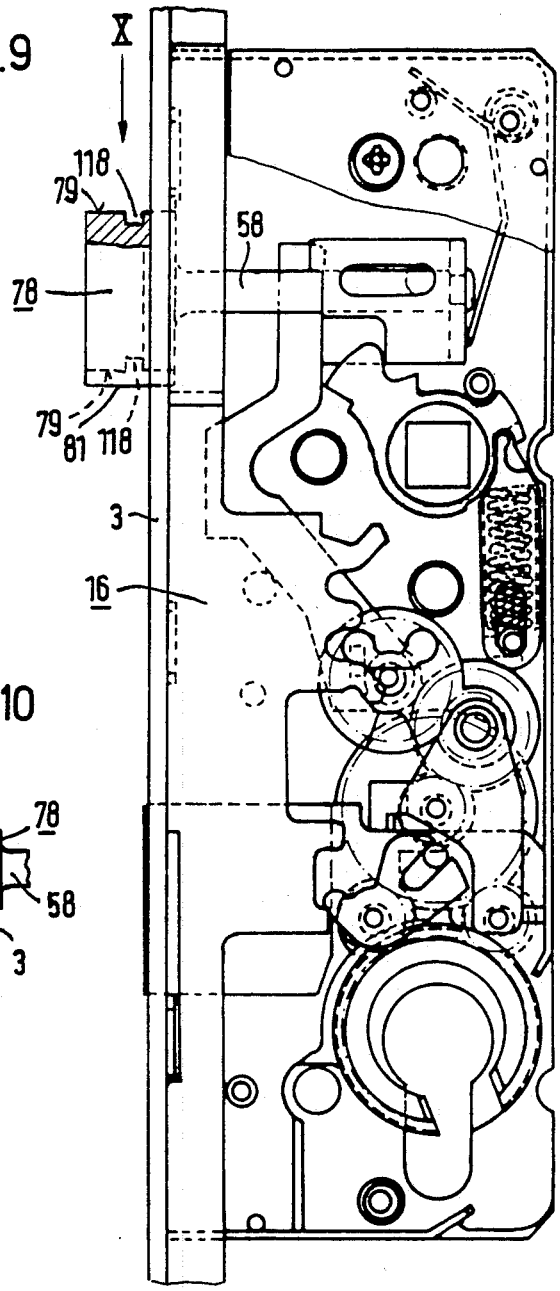
FIG. 9 represents an arrangement according to FIG. 1 with a modified configuration of the catch.
Figure 10:
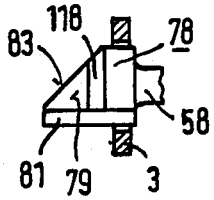
FIG. 10 represents a plan view of the catch in the direction of the arrow X in FIG. 9.

According to FIGS. 9 and 10 the catch 78 comprises grooves 118 in its end faces 79, which extend only just outside the flange rail 3 parallel with the flange rail 3 and end at guide ribs by which the catch is guided in a piercing of the flange rail. If a pressure is exerted upon the edge 83 with a flat bar or a metal plate in order to press the catch back, this flat bar comes into the groove 118 and prevents further backward movement of the catch 78.

The distance of the groove 118 from the outside of the flange rail 3 is about 1 mm., when the catch 78 is fully extended.

A further aspect of the invention will be discussed hereinafter with reference to FIGS. 11 to 15. Analogous parts are designated in FIGS. 11 to 15 with the same references as in FIGS. 1 to 3.

Figure 11:
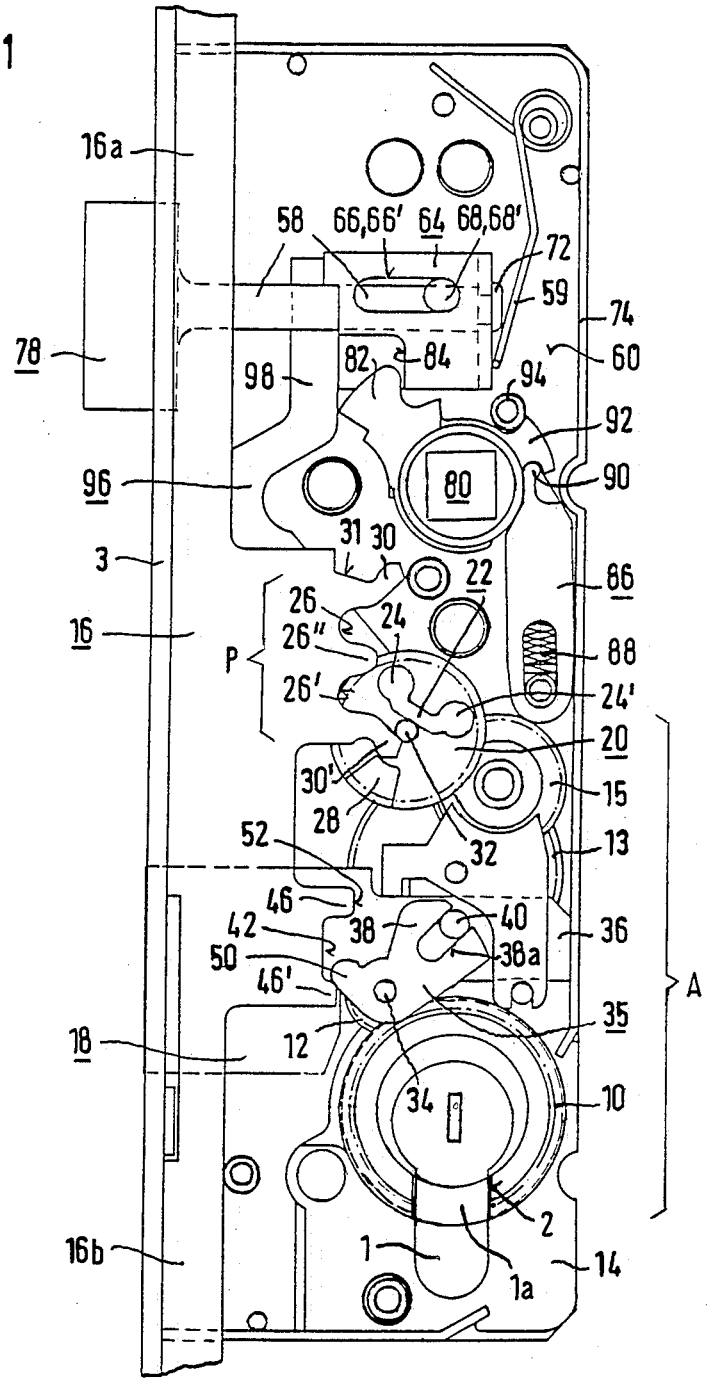
FIG. 11 represents a form of embodiment corresponding to FIGS. 1 and 1*a* in a gearing condition in which the lock bit is situated in the zero degree position and the key can be inserted and withdrawn.

In FIG. 11 the lock bit 1*a* is situated in the zero degree position. Let it be assumed that the key can be inserted and withdrawn in this zero degree position. The toothed rim 10 is situated with its gap 2 likewise in the zero degree position.

The position of a gear output wheel or drive rod drive pinion 20 is defined by means of the gear wheels 12, 13 and 15. The gear output wheel 20 comprises dogs 24 and 24' in dumbell-shaped arrangement 22. The dogs 24 and 24' are intended for engagement with a special profiling P on a drive rod 16. The drive rod 16 is connected with drive rod sections 16*a* and 16*b* for common movement in a vertical direction. In the special profiling P there are two recesses 26 and 26'. Furthermore the special profiling P has two limiting fingers 30 and 30'. Moreover a stop dog 28 is fitted on the gear output wheel 20.

The displacement of the drive rod 16 in vertical direction is effected due to the fact that on a rotation of the gear output wheel 20 firstly the dog 24 engages in the recess 26' and later the dog 24' engages in the recess 26. The converse operation takes its course when by rotation of the gear output wheel 20 in the counter-clockwise direction the drive rod 16 is to be shifted back upwards.

When the drive rod 16 is in the position as reproduced in FIG. 11, the bolt parts (not shown) fitted on the drive rod sections 16*a* and 16*b* do not engage in bolt engagement elements of the door frame (likewise not shown). On the contrary such an engagement takes place when the drive rod 16 is in the lowermost position.

Figure 15:
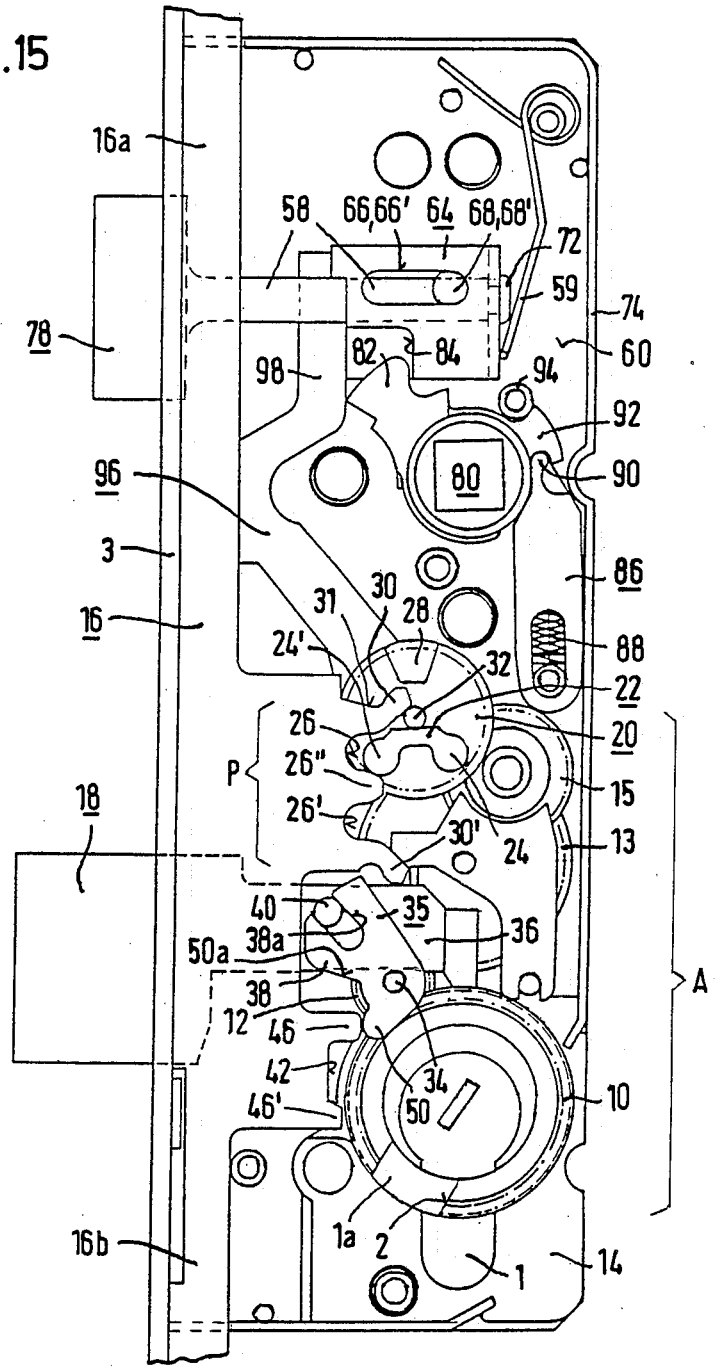
FIG. 15 represents a lock according to FIG. 11 with pre-closed thrust bolt.

Furthermore a bolt 18 is provided. This bolt 18 can be driven out as represented in FIG. 15.

For the pre-closing of the bolt 18 a conversion lever 35 (bell-crank lever) is provided. This conversion lever 35 pivots about a spindle 34. The upper end of the conversion lever 35 is connected by a slot 38*a* and a pin 40 with the bolt 18.

Two drive dogs 46, 46' are fitted on the drive rod 16. These drive dogs 46, 46' co-operate with a counter-dog 50 of the conversion lever 35. A recess 42 is provided between the two drive dogs 46 and 46'.

In the unblocked condition as shown in FIG. 11 the drive dog 46' lies against the counter-dog 50, so that the conversion lever 35 is hindered from pivoting int he counter-clockwise direction about the spindle 34. When the drive rod 16 is moved downwards by rotation of the gear output wheel 20 in the counter-clockwise direction (the rotation is introduced from the lock cylinder through the gear wheels 12, 13 and 15), then the recess 42 firstly travels away over the counter-dog and then the drive dog 46 runs up on to the counter-dog 50. During the free dipping of the counter-dog 50 into the recess 42 the conversion lever 35 is not unambiguously determined in its position. It can oscillate and the bolt 13 can correspondingly move freely to and fro.

If now the drive dog 46 runs up on to the counter-dog 50, then the conversion lever 35 is pivoted in the counter-clockwise direction about the spindle 34 and begins to shift the bolt 18 to the left in the direction towards the position as represented in FIG. 15. Even during the commencing pivoting of the conversion lever 35 in the counter-clockwise direction the position of the conversion lever 35 is not unambiguously fixed. The conversion lever 35 can still swing. Only when the drive dog 46 has come with its vertically extending edge into engagement with the counter-dog 50 is the conversion lever 35 hindered from swinging and the bolt 18 made fast in its extreme left position (see FIG. 15). Then the lock is blocked.

The retraction of the bolt 18 takes place on upward movement of the drive rod 16, the counter-dog 50 travelling through the recess 42, the flank 50*a* being struck by the drive dog 46 and finally the drive dog 46' resting again on the counter-dog 50, as represented in FIG. 11. In the intermediate positions the conversion lever 35 can here again swing and accordingly the bolt 18 can move uncontrollably in the horizontal direction.

Figure 12:
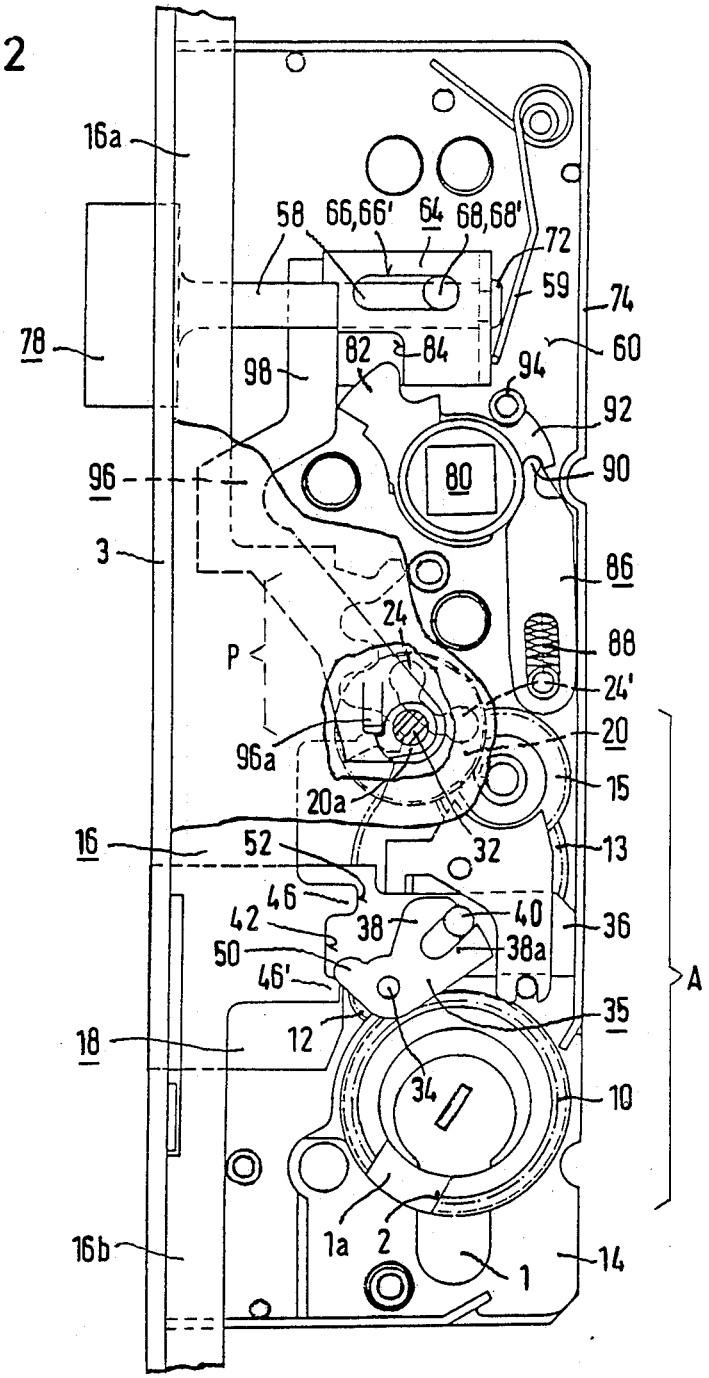
FIG. 12 represents the beginning of the catch retraction in the form of embodiment according to FIG. 11, in another sectional plane.

The retraction of the catch 78 appears from FIG. 12. The lock bit 1*a* and with it the slot 2 of the toothed rim 10 have been rotated so far into an approximately +30° position that the retraction of the catch 78 can commence. On the gear output wheel there is fitted, as may be seen from FIG. 12, an engaging member 20*a*. This engaging member 20*a* is situated on the under side of the gear output wheel 20 and therefore does not appear in FIG. 11. The engaging member 20*a* is intended to co-operate with an outwardly embossed portion 96*a* which is formed on a catch lever 96. The catch lever 96 is pivotable about the spindle 32 of the gear output wheel 20 and acts with its upper end upon a catch tail 58, 64 which moreover is subject to the force of a spring 59.

When the toothed rim 10 with the lock bit 1*a* has reached the +30° position illustrated in FIG. 12, the gear output wheel 20 has rotated so far that the engaging member 20*a* abuts on the embossed portion 96*a*. Thus on further rotation of the gear output wheel 20 in the clockwise direction the catch lever 96 likewise begins to pivot in the clockwise direction and to retract the catch 78. When the lock bit 1*a* has reached an approximately +90° position, the catch 78 is completely retracted.

Regarding the various positions as illustrated in FIGS. 11 to 15 now the following is to be determined:

(a) FIG. 11 shows the basic position. While the lock bit 1*a* and the toothed rim 10 are situated in the zero degree position, in which the key can be inserted and withdrawn, the drive rod 16 is laid by means of the gear output wheel 20 with the dogs 24 and 24' for the one part and the special profile P for the other part into the unlocking position in which the bolt parts arranged on the drive rod sections 16*a* and 16*b* are out of engagement with the corresponding bolt engagement elements of the door frame. The limiting finger 30' of the special profile P engage between the stop 28 of the gear output wheel 20 and the spindle 32, on which the gear output wheel 20 is rotatably mounted. The drive rod 16 is blocked against displacement in the vertical direction, except at most for an extremely slight tolerance-caused play.

The bolt 18 is situated in the retracted position, namely thanks to the engagement of the drive dog 46' on the counter-dog 50 and the engagement of the pin 40 in the slot 38*a*. In that case the conversion lever 35 cannot pivot, at most ignoring tolerance-caused small angle movements, and the bolt 18 cannot shift in the transverse direction, again ignoring at most small tolerance-caused strokes which correspond to the mentioned small tolerance-caused angle movements.

The catch 78 is situated, under the action of the spring 59, in the position protruding beyond the flange plate 3, in which it can yield to the right against the action of the spring 59 on slamming of the door. The catch assumes its position as illustrated in FIG. 11 because it is not influenced by the catch lever 96 for the catch lever 96 with its embossed portion 96*a* is not loaded by the engaging member 20*a* of the gear output wheel 20 (FIG. 12), therefore assumes the position represented in FIG. 12 in solid lines and does not act upon the catch tail 58, 64.

(b) When the lock is to be blocked, the key is turned in the counter-clockwise direction, starting from FIG. 11, and thus the toothed rim 10 also rotates in the counter-clockwise direction. The gear output wheel 20 then experiences a rotation in the counter-clockwise direction about the spindle 32.

After a rotating movement of the lock bit 1*a* through about −120° the dog 24 strikes against the lower flank of the recess 26', so that a downward movement of the drive rod 16 begins. This downward movement can begin because then the stop has already rotated so far in the counter-clockwise direction in relation to the position according to FIG. 11 that the limiting finger 30' can travel downwards past the stop 28.

In the further course of the rotation of the lock bit 1*a* in the counter-clockwise direction and of the consequent rotation of the gear output wheel 20 likewise in the counter-clockwise direction then the dog 24 again comes out of the recess 26' and the dog 24' enters the recess 26 in order, on further rotation of the gear output wheel 20 in the counter-clockwise direction, to shift the drive rod 16 still further downwards.

After a rotation of the lock bit 1*a* through 360°+270° the condition is reached as represented in FIG. 15. This is not yet the full blocked position. The fully blocked position is finally reached only after a rotation of the lock bit 1*a* through 2×360° in relation to the condition according to FIG. 11. The dog 24' has then shifted the drive rod 16 further downwards compared with the condition in FIG. 15 and the limiting finger 30 is now situated between the spindle 32 and the stop 28. Here the bolt parts (not shown) fitted on the drive rod sections 16*a* and 16*b* have entered the bolt engagement elements of the door frame and an action upon the drive rod 16 can no longer lead to their displacement, because the limiting finger 30 is then blocked in between the spindle 32 and the stop 28.

In the downward movement of the drive rod 16 due to rotation of the key in the counter-clockwise direction and consequent rotation of the gear output wheel 20 in the counter-clockwise direction too, the bolt 18 is also transferred into the blocking position. When the drive dog 46 of the drive rod 16 strikes upon the counter-dog 50, after the counter-dog 50 has run through the recess 42, a pivoting movement of the conversion lever 35 in the counter-clockwise direction begins and this pivoting movement is converted through the pin-slot connection 40, 38*a* into a displacement movement of the bolt 18, which moves to the left. As soon as the vertical edge 52 of the drive dog 46 rests on the counter-dog 50—this is achieved after approximately a rotation of 360°+270° of the lock bit 1*a*—the bolt 18 is run fully out (see FIG. 15) so that in the final phase of the rotation of the lock bit 1*a* from the condition according to FIG. 15 until the return of the lock bit 1*a* into the zero degree position (the lock bit has then rotated through a total of 2×360°) a further displacement of the bolt 18 no longer takes place.

(c) When the lock is to be unblocked, the key is turned back in the clockwise direction until the lock bit 1*a* has again reached the position according to FIG. 11. All parts of the lock then again assume the position as illustrated in FIG. 11.

(d) When the door is to be opened by the lock cylinder 1, the catch 78 must also be retracted. For this purpose the key is rotated, starting from the position according to FIG. 11, into the position according to FIG. 12 and further through about 45° in the clockwise direction. Then according to FIG. 12 the engaging member 20*a* of the gear output wheel 20 acts upon the embossed portion 96*a*, the catch lever 96 is pivoted in the clockwise direction and acts upon the catch tail 58, 64 and thus retracts the catch 78.

For the retraction of the catch 78 an upward movement of the drive rod 16 is not provided. This is seen from FIGS. 11 and 12. If, starting from the condition according to FIG. 11, the gear output wheel 20 is rotated in the clockwise direction, then—as may easily be seen from FIGS. 11 and 12—no more action of any kind of the dog 24 upon the special profile P occurs. This mean that the drive rod 16 is no longer displaced. It cannot be displaced any more at all, because the limiting finger 30' is caught between the stop 28 and the spindle 32 immovably except for at most slight tolerance mobility.

It is to be retained that the retraction of the catch 78 is possible without movement of the drive rod 16, because the drive for the catch lever 96 is not derived from the drive rod 16, but from the gear output wheel 20. This is a considerable advantage because in the opening of the door by retraction of the catch 78 by means of the key only the toothed-wheel gearing as far as and including the gear output wheel 20 and the catch lever 96 must be moved with the catch 78, but not the drive rod 16 with the drive rod sections 16*a* and 16*b*. Thus firstly the actuation of the key for the purpose of retracting the catch 78 becomes more easy in motion; moreover it is not also necessary to provide an additional release play, taking account of a movement of the drive rod in the retraction of the catch 78 by key actuation, between the bolt parts provided on the drive rod sections 16*a* and 16*b* and the pertinent bolt engagement elements of the door frame. Since in the retraction of the catch 78 by key actuation the drive rod 16 is not moved (and also cannot be moved), in this catch retraction the bolt 18 is also not moved.

Figure 13:
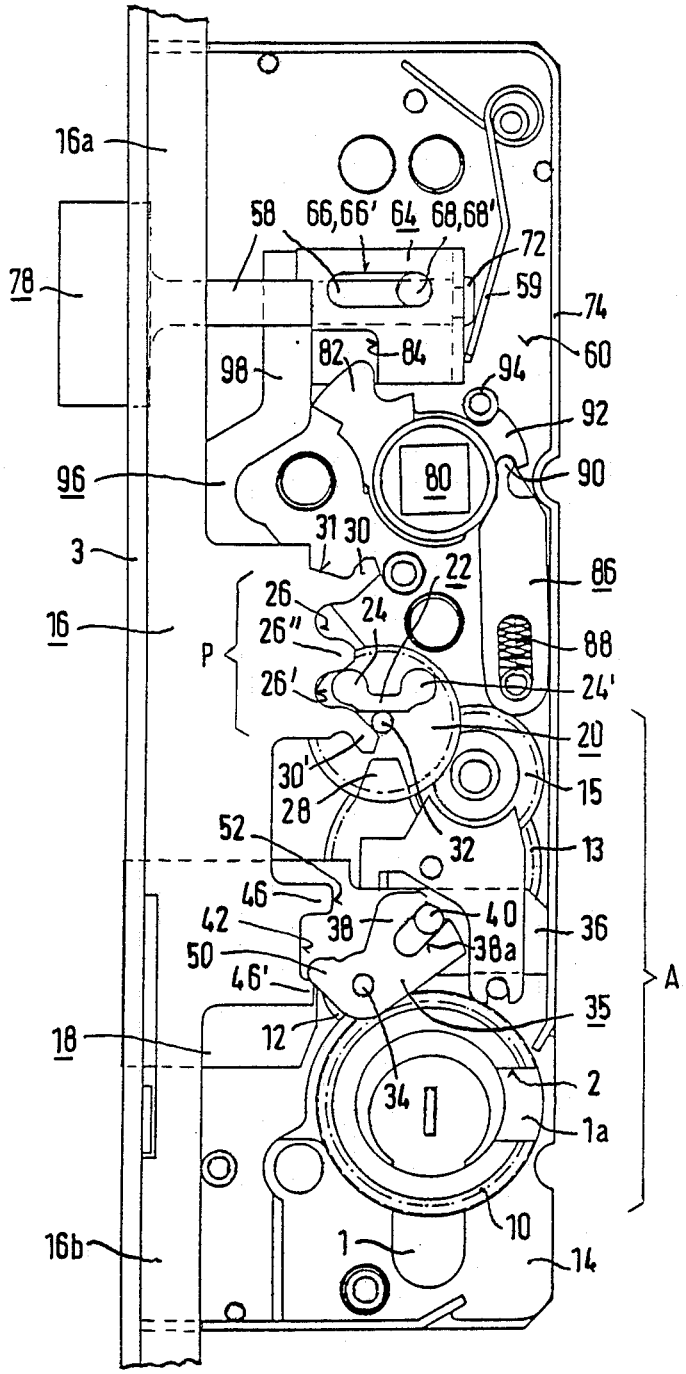
FIG. 13 represents a modification of the form of embodiment according to FIG. 11, using a lock cylinder having a lock bit protruding laterally at an angle of −90° in the key withdrawal position.

(e) Now the requirement exists that in the key withdrawal position the lock bit 1*a* is pivoted out of the zero degree position (FIG. 11), somewhat as in FIG. 13, so that it can offer a halt to a driving-through of the lock cylinder 1 in the longitudinal direction of the lock cylinder axis. Since now the lock cylinder 1 can be introduced into the corresponding push-through opening of the lock cover or of the lock bottom 60 only if the lock bit 1*a* is situated in the zero degree position, thus the lock cylinder 1 must be introduced through the lock cover or the lock bottom 60 in a situation in which the lock cylinder core with the key is rotated so far in relation to the key withdrawal position that the lock bit 1*a* assumes the zero degree position.

Once the lock cylinder 1 is introduced in this manner, the lock cylinder core can be turned back with the key into the key withdrawal position in which then the lock bit 1a assumes an angle position set out in relation to the zero degree position, somewhat such as is represented in FIG. 13, where the key is situated in the key withdrawal position and the lock bit is situated in a −90° position. Here again, that is in the transference of the lock bit into the −90° position after prior introduction of the lock cylinder 1 through the opening of the lock cover, the bolt 18 does not move. The formation of the gear output wheel 20 and of the special profile P on the drive rod 6 ensures this.

The introduction of a lock cylinder 1 corresponding to FIG. 13 with a lock bit 1a protruding at an angle of −90° in the key withdrawal position takes place again in a lock bit position corresponding to FIG. 11, in which the introduction of the lock cylinder 1 is alone possible. In order then to bring the lock cylinder core and thus the key into the key insertion or key withdrawal position, a rotation of the key is effected through 90°, the lock bit travelling from the position according to FIG. 11 into the position according to FIG. 13.

In this travel the dog 24 of the gear output wheel 20 moves from the position as shown in FIG. 11 into the position as shown in FIG. 13, without a displacement of the drive rod 16 taking place. This is seen from the fact that according to FIG. 11 the dog 24 goes past the middle elevation 26'' of the special profile P without exerting a thrust upon the drive rod 16, and further from the fact that in the situation according to FIG. 13 the dog 24 has not yet come into engagement with the lower flank of the recess 26'. This has to be so, because during the rotation distance of the gear output wheel 20 from the position according to FIG. 11 into the condition according to FIG. 13 the limiting finger 30' is blocked in between the spindle 32 and the stop 28, apart from an at most small, tolerance-caused play, that is a movement of the drive rod 16 could not take place at all without the occurrence of an inner blocking of the entire system.

Figure 14:
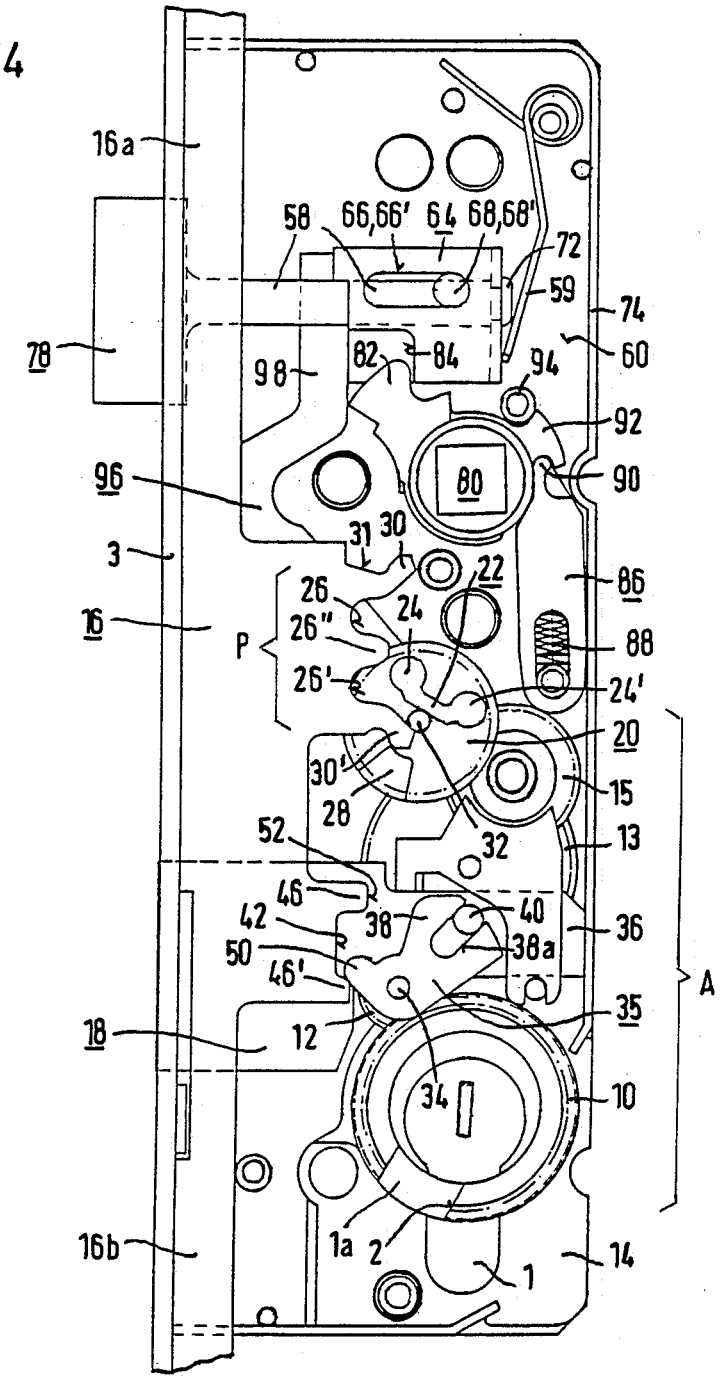
FIG. 14 represents a modification of FIG. 11 with a look bit protruding laterally at +30° in the key withdrawal position.

It is readily possible to imagine that it is also possible to introduce into the lock a lock cylinder 1 the lock bit 1a of which is set out approximately by +45° in the lock withdrawal position, or by +30°, as represented in FIG. 14. Again the lock bit 1a would have to be brought into the zero degree position for the introduction of the profiled lock cylinder 1 into the opening of the lock cove or of the lock bottom 60, thus the lock cylinder core with the key would have to be turned correspondingly out of the key insertion and key withdrawal position, so that the lock bit 1a assumes the position according to FIG. 11. Then the lock cylinder core with the key would have to be turned back into the key withdrawal and key insertion position, whereupon the lock bit arrives in the +45° position or +30° position according to FIG. 14.

It is seen that in the transition of the lock bit 1a from the position in FIG. 11 to the position in FIG. 14 and also into the +45° position the dog 24 is situated completely outside the engagement with the special profile P and the limiting finger 30' is again caught between the stop 28 and the spindle 32. Thus a change of position of the drive rod 16 does not take place and also could not take place. Since the position of the bolt 18 is dependent upon the position of the drive rod 16, no movement of the drive rod 16 takes place even in the case of insertion of a lock cylinder 1 with a lock bit 1a protruding at +30° or +45° in the key withdrawal position, and in the subsequent return of the key into the zero degree position and corresponding setting out of the lock bit 1a.

(f) It should be mentioned that the possibility of setting out the lock bit 1a is limited in the drive rod lock according to the invention. It is not possible to set out beyond the +30° position according to FIG. 14, because then the action upon the catch 78 begins against the action of the spring 59 and because then the withdrawal position of the key would no longer be stable but could be brought about only with action upon the key.

On the other hand however a setting out of the lock bit beyond the −90° position according to FIG. 13 is also impossible, namely for the following reason: As stated earlier, the lock is designed according to purpose so that the complete pushing out of the drive rod 16 occurs after a double 360° rotation out of the condition according to FIG. 13 and then the key can be withdrawn. If now the lock bit 1a at the beginning of the locking rotation is already situated in the −90° position of FIG. 13, then after a double 360° rotation of the key a condition is reached in which the stop 28 abuts against the flank 31 of the limiting finger 30'. This means that on a setting out of the lock bit 1a beyond the 90° position according to FIG. 13, the double 60° rotation could no longer be carried out, thus the key withdrawal position could no longer be reached. The range of variation of the lock bit 1a is therefore limited in the lock in accordance with the invention to the range between +30° according to FIG. 14 and −90° according to FIG. 13. This signifies that—as set forth further above—the lock bit 1a can be varied only in such an angle range in which no thrust engagement takes place between the dog 24 and the special profile P, and consequently the drive rod 16 and the bolt 18 are not moved. If nevertheless an idle motion is provided between the drive rod 16 and the bolt 18, resulting from the width of the recess 42 between the two drive dogs 46 and 46', then this idle motion has nothing to do with the requirement for variability of the setting-out angle of the lock bit 1a. The idle motion effected by the width of the recess 42 is provided because of a completely different consideration. If one were to provide a constantly shaped-engaging engagement between the drive dogs 46, 46' for the one part and the counter-dog 50 for the other, then under the existing space conditions and with maintenance of the width of the drive rod 16 necessary for strength reasons it would not be possible to adapt the two-revolution rotation of the lock cylinder core to that rotating movement of the conversion lever 35 which is necessary in order, after double 360° rotation of the lock cylinder core, to have the bolt 18 in the fully pushed-out position, no more and no less.

Figure 16:
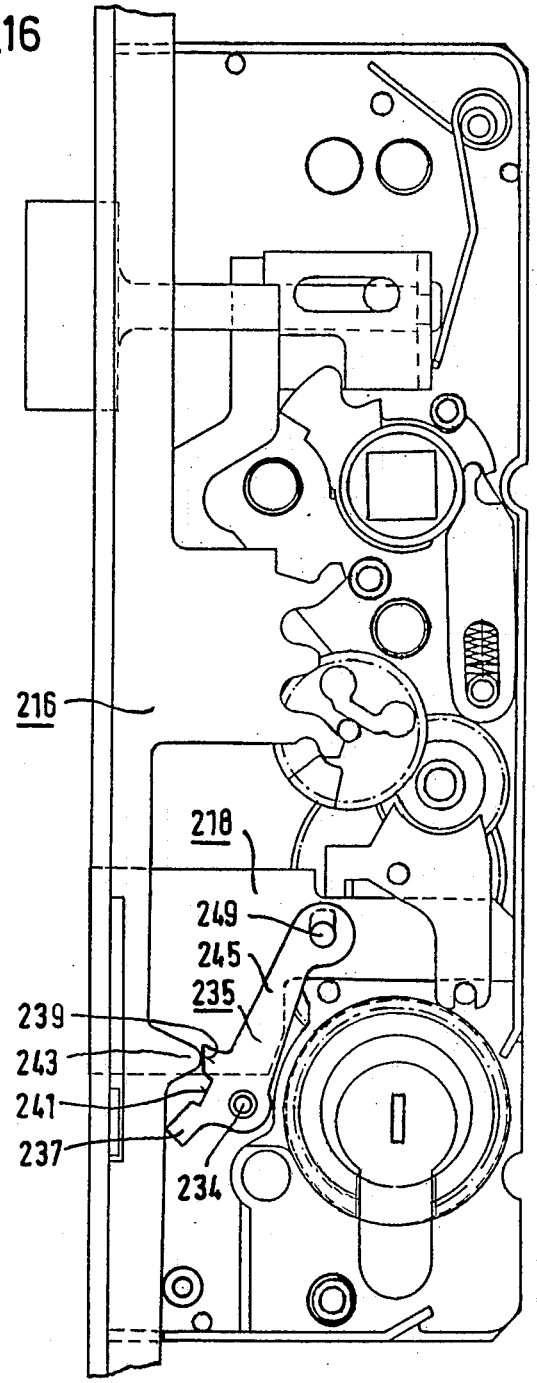
FIGS. 16 and 17 represent further forms of embodiment for the gear connection between the drive rod and the bolt.

In FIG. 16, which corresponds approximately to the position according to FIG. 11, the conversion lever 235 is modified in comparison with the form of embodiment according to FIG. 11. This conversion lever 235 is again pivotable about a non-displaceable axis 234 and possesses two teeth 237, 239, namely a bolt extension tooth 237 and a bolt retraction tooth 239. Between these teeth there lies a tooth notch 241. In the blocking of the lock the drive rod 216 goes downwards and strikes with its nose 243 against the tooth 237, so that the bolt is closed by the conversion lever 235. If the nose 243 is situated in the region of the tooth notch 241, idle motion is again possible. The idle motion is here provided for the same reason, and only for the same reason, as set forth above with regard to the forms of embodiment according to FIGS. 11 to 15. The lever 235 comprises a bolt engagement arm 245 which acts through a pin-slot connection 249 upon the bolt 218.

Figure 17:
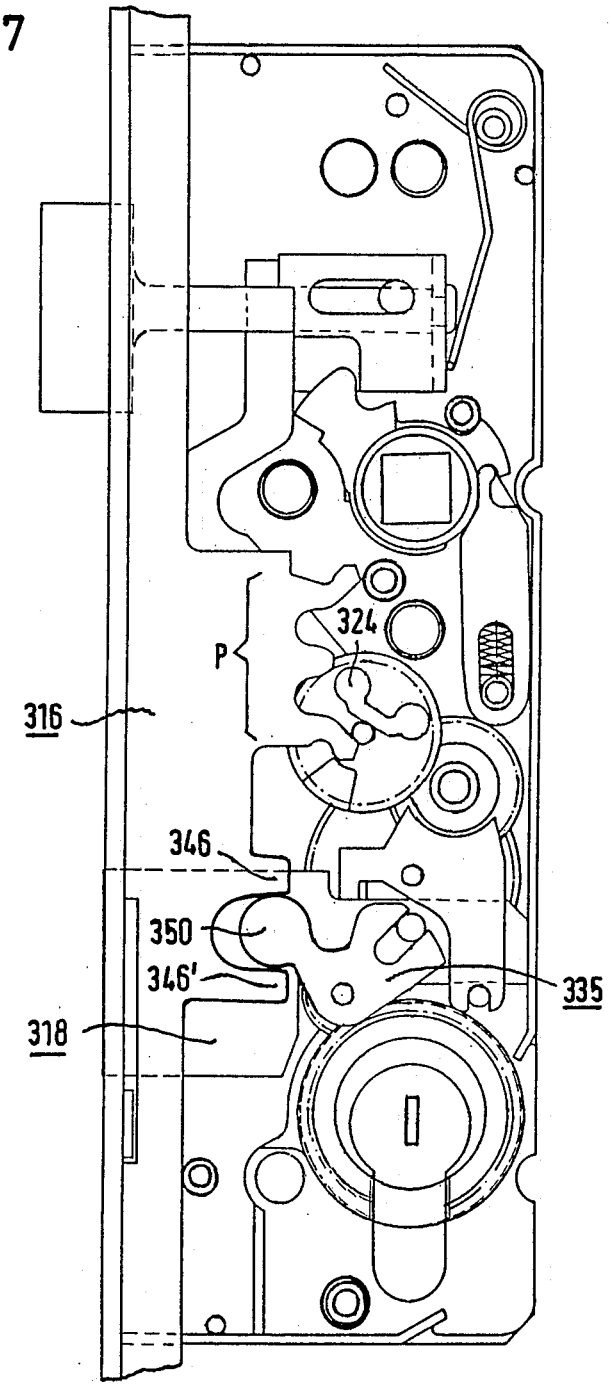

The form of embodiment according to FIG. 17 shows a further modification of the gear connection between the push rod 316 and the bolt 318. The position of FIG. 17 again corresponds approximately to the position according to FIG. 11. In departure from the form of embodiment according to FIG. 11, the counter-dog 350 of the conversion lever 335 engages in shape-locking manner between two correspondingly dimensioned drive dogs 346 and 346' of the drive rod 316. The idle motion between the drive rod 316 for the one part and the conversion lever 33 and thus also the thrust bolt 318 for the other part is there completely suppressed. Nevertheless by reason of the unchanged engagement conditions between the dog 324 and the special profile P the same possibility of variation is given for the position of the lock bit between +30° and −90°.

I claim:

1. Drive rod lock comprising a drive rod (16) displaceable between an open position (FIGS. 1 and 1*a*) and a closure position (FIG. 2) in combination with at least one lock element (18, 78, 106, 114, 116), a lock cylinder (1), a step-down gearing (A) between the lock cylinder (1) and the drive rode (16) for the displacement of the drive rod (16) between the open position and the closure position and a blocking device (28, 30) for the drive rod (16) which blocks the drive rode (16) in the closure position (FIG. 2) against displacement in the direction of the open position (FIGS. 1 and 1*a*) without torque introduction into the step-down gearing (A), where a control dog construction group (22) is fitted on the gear output drive rod drive pinion (20) for drive engagement with a dog engagement profiling (26, 26') of the drive rode (16) and where further a stop dog (28) is fitted on the gear output drive rode drive pinion (20) for action upon a counter-abutment face (31) of the drive rod (16), characterized in that (a) the dog engagement profiling (26, 26') is made with two recesses (26, 26'), (b) the drive dog construction group (22) comprises two preferably circular control dogs fitted on the drive dog drive pinion (20), which dogs engage successively in recesses (26, 26') allocated to them by pairs, (c) the stop dog (28) is arranged in the middle region of the circumferential distance between the two control dogs (24, 24') on the drive rod drive pinion (20), (d) the recess (26) loaded by a control dog in the closure position (FIG. 2) of the drive rode (16) is made with a limiting finger (30), (e) the stop dog (28) rests, when the drive rod is in the closure position (FIG. 2), on the flank (31), called blocking flank (31), of the limiting finger (30) which is remote from the recess (26) loaded by the control dog, (f) the drive rod (16) reaches its closure position before the closing rotating movement of the lock cylinder (1) and of the drive rode drive pinion (20) is terminated and the stop dog (28) after entry of the drive rod (16) into the locked position (FIG. 2), during the thereafter available remaining closure rotating movement of the lock cylinder (1) and of the drive rode drive pinion (20), reaches its blocking position on the blocking flank (31) of the limiting finger (30).

2. Drive rode lock according to claim 1, characterised in that the drive rod (16), staring from the open position (FIGS. 1 and 1*a*) and correspondingly from a zero position (key withdrawal position) of the lock cylinder (1) reaches its closure position after less than 2×360° lock cylinder rotation, and in that the remaining lock cylinder rotation up to 2×360° serves for driving the stop dog (28) into the blocking position in relation to the blocking flank (31) of the limiting finger (30).

3. Drive rod locking according to claim 2, characterised in that the drive rod drive pinion (20) carries out a locking rotating movement of about 200° in the case of a locking rotating movement of the lock cylinder (1) of 2×360°.

4. Drive rod lock according to claim 3, characterised in that the remaining locking rotating movement of the drive rode drive pinion (20) after entry of the drive (16) into the closure position (FIG. 2) amounts to about 20°.

5. Drive rod lock according to claim 1, characterised in that the control dogs (24, 24') and the stop dog (28) protrude axially from one end face of the drive rod drive pinion (20) and in that a part of the drive rod (16) carrying the recesses (26, 26') rests on this end face of the drive rod drive pinion (20).

6. Drive rode lock according to claim 1, characterised in that the control dogs (24, 24') have a circumferential interval of about 90° and in the that the circumferential interval of the stop dog (28) from the two control dogs (24, 24') amounts in each case to about 135°.

7. Drive rod lock according to claim 1, characterised in that the control dogs (24, 24') are connected with one another by a flange, forming an aperture lying between them for the engagement of a projection (25) lying between the two recesses (26, 26').

8. Drive rode lock according to claim 1, wherein a bolt (18) movable transversely of the direction of movement of the drive rode is provided and is displaceable by the drive rod (16) between a retracted position (FIG. 1 and 1*a*) and an extended position (FIG. 2), characterised in that a stationarily mounted bell-crank layer (35) engages with a first arm (38) through a pin-slot connection (38, 40) on a bolt tail (36) of the bolt (13) and comprises a second arm (50), namely a control arm (50), which is in engagement with a control profile (44', 44, 52) of the drive rod (16).

9. Drive rod lock according to claim 8, characterised in that the control profile (44', 44, 52) comprises control faces (44, 44') arranged with spacing and at right angles to the direction of movement of the bolt (18) for the extension and retraction of the bolt (18) and an end face (52), substantially parallel to the direction of movement of the drive rod (16) for the blocking of the extended bolt (18).

10. Drive rod lock according to claim 8, characterised in that a shoulder (56) is provided on the bolt (18) and a shoulder engagement pin (54) is provided on the drive rod (16), the shoulder engagement pin (54) coming into bolt blocking engagement behind the shoulder (56) after the bolt (13 has reached its fully extended position (FIG. 2).

11. Drive rot lock according to claim 1, where at least one pivot bolt (106) is pivotable between a pivoted-in and a pivoted-out position (FIGS. 4 and 5) by the drive rod (16), characterised in that for the pivoting of the pivot bolt (106) a rack (108) is fitted on the drive rod (16) and a toothed segment (110) on the pivot bolt (106).

12. Drive rod lock according to claim 11, characterised int hat the toothed segment (110) is fitted on a hub part of the hook-shaped pivot bolt (106).

13. Drive rode lock according to claim 11, characterised in that the pivot bolt (106) is part of an additional lock (104) secured on a flange rail (3).

14. Drive rod lock according to claim 1, characterised in that it comprises a catch (78)m which is retractable out of a locking position reached under spring pressure (59), according to choice, by rotation of a handle nut (80) or from the lock cylinder (1) into an open position (FIG. 3).

15. Drive rod lock according to claim 14, characterised in that an engaging member (100) which in the rotation of the lock cylinder (1) beyond its zero position corresponding to the open position of the drive rod (16) strikes against a nose (102) of a catch lever (96) acting upon the catch (78) is fitted on the drive rod drive pinion (20).

16. Drive rod lock comprising a drive rod (16) displaceable between an open position (FIG. 11) and a closure position (FIG. 15), in connection with at least one lock element (18), a lock cylinder (1), a step-down gearing (A) between the lock cylinder (1) and the drive rod (16) for displacing the drive rod (16) between the open position (FIG. 11) and the closure position (FIG. 15), where the step-down gearing (A) possesses on the lock cylinder side a toothed rim (10) which meshes with two drive-output wheels (12, 12') arranged after it and comprises a slot (2) open to the edge and formed for insertion of the lock bit (1*a*) of the lock cylinder (1), and where a drive rod drive member (20) of the step-down gearing (A), which member is rotatable about a non-displaceable axis (32), acts through an engaging device (24, 24', P) upon the drive rod (16), further comprising a bolt (18) which is displaceable transversely of the longitudinal axis of the drive rod (16) between a retracted position (FIG. 11) and an extended position (FIG. 15) and is driveable in response to the drive rod movement through movement conversion means (46, 46', 38, 38*a*, 40)

and further comprising a catch (78) prestressed by spring force (59) into a closure position, which is retractable for the one part from a handle nut (80) and for the other from the lock cylinder (1), against the spring force (59), where the slot (2) of the toothed rim (10) is displaceable out of its zero degree position in at least one direction of rotation over a range of angle of variation of the lock bit (1*a*), without the occurrence of shift of the thrust bolt (18), a dog construction group (22) being provided on the drive rod driver member (20), with two control dogs (24, 24') and a stop dog (28) and a dog engagement profiling (P) being mounted for common linear movement with the drive rod (16) and provided with two recesses (26, 26') pertaining by pairs to the control dogs (24, 24') and two limiting fingers (30, 30') on both sides of the recesses (26, 26'), said dog construction group (22) and said dog engagement profiling (P) being so formed that on a rotation of the toothed rim (10) within the range of variation angle of the lock bit (1*a*) the engagement connection of the control dog (24), which is responsible for the beginning of the drive rod displacement out of the open position into the closure position, with the pertinent recess (26') is released and the limiting finger (30') pertaining to this recess (26') engages between the stop dog (28) and the axis (32) of the drive rod drive member (20), substantially blocking the displacement of the drive rod (16).

17. Drive rod lock according to claim 16, characterised in that the movement conversion means (46, 46', 35, 38*a*, 40) between the bolt (18) and the drive rod (16) comprise a conversion lever (bell-crank lever 35) pivotably mounted on the lock housing (at 34), which conversion lever for the one part is in toothing-type engagement with the drive rod (16) and for the other part is in connection with the bolt (18) through a pin/slot connection (38*a*, 40).

18. Drive rod lock according to claim 17, characterised in that the toothing-type engagement between the drive rod (16) and the conversion lever (35) possesses idle motion.

19. Drive rod lock according to claim 17, characterised in that the conversion lever (35) is a double lever which is in engagement by a counter-dog (50) with a toothing (46, 42, 46') of the drive rod (16) and comprises in one arm (38) a slot (38*a*) which surrounds a pin (40) of the bolt (18) in fork manner.

20. Drive rod lock according to claim 19, characterised in that the toothing (46, 42, 46') comprises two drive dogs (46, 46') spaced by recesses (42) ensuring an idle motion, namely a bolt-expelling drive dog (46) and a bolt-retracting drive dog (46').

21. Drive rod lock according to claim 17, characterised int hat the toothing-type engagement between the drive rod (216) and the conversion lever (235) is formed by a nose (243) of the drive rod (216) for the one part and two teeth (239, 237), separated by a tooth notch (241), of the conversion lever (235) for the other part, and in that the conversion lever (235) comprises a bolt engagement arm (245) which engages with a pin in a slot of the bolt (218) (slot/pin connection 249).

22. Drive rod lock according to claim 21, characterised in that the tooth notch (241) is formed as a tooth notch ensuring an idle motion.

23. Drive rod lock according to claim 16, characterises in that the dog construction group (22) provided on the drive rod drive member (20) is formed with two control dogs (24, 24') and a stop dog (28) and the dog engagement profiling (P) fitted on the drive rod (16) is formed with two recesses (26, 26') pertaining by pairs to the control dogs (24, 24') and the limiting finger (30, 30') on both sides of the recesses (26, 26'), in such a way that on a rotation of the toothed rim (10) within the range of angle of variation of the lock bit (1*a*), the engagement connection of the control dog (24'), which is responsible for the end of the drive rod displacement out of the open position into the closure position, with the pertinent recess (26) is released, and the limiting finger (30) pertaining to this recess (26) engages, substantially blocking the displacement of the drive rod (16), between the stop dog (28) and the axis (32) of the drive rod drive member (20).

24. Drive rod lock according to claim 16, characterised in that the range of angle of variation reaches from +45° to −90°.

25. Drive rod lock according to claim 16, characterised in that the catch (78) is retractable by an engaging member (20*a*) of the drive rod drive member (20).

26. Drive rod lock according to claim 17, wherein said conversion lever has a lever arm engageable with an engagement face substantially parallel with the longitudinal axis of said drive rod (16), when said bolt (18) is in said extended position.

* * * * *